US005969242A

United States Patent [19]

Hubbell et al.

[11] Patent Number: 5,969,242

[45] Date of Patent: Oct. 19, 1999

[54] ISOBARIC GROUNDWATER WELL

[75] Inventors: Joel M. Hubbell; James B. Sisson, both of Idaho Falls, Id.

[73] Assignee: Lockheed Martin Idaho Technologies Company, Idaho Falls, Id.

[21] Appl. No.: 09/071,070

[22] Filed: Apr. 30, 1998

[51] Int. Cl.[6] ..... E21B 47/00; E21B 43/00; G01N 7/10

[52] U.S. Cl. ..... 73/152.51; 73/152.55; 73/76; 166/250.03; 166/264

[58] Field of Search ..... 73/152.51, 152.55, 73/863.71, 73, 76; 166/51, 313, 316, 332, 264, 250.03

[56] References Cited

U.S. PATENT DOCUMENTS

| | | | |
|---|---|---|---|
| 2,605,637 | 8/1952 | Rhoades | 73/151 |
| 3,049,920 | 8/1962 | Allen | 73/291 |
| 3,443,643 | 5/1969 | Jones | 175/25 |
| 3,448,611 | 6/1969 | Lebourg | 73/151 |
| 3,478,584 | 11/1969 | Strubhar et al. | 73/155 |
| 3,559,476 | 2/1971 | Kuo et al. | 73/155 |
| 3,771,360 | 11/1973 | Prats | 73/155 |
| 3,898,872 | 8/1975 | Skaling et al. | 73/73 |
| 3,940,980 | 3/1976 | Tasker et al. | 73/152 |
| 4,068,525 | 1/1978 | Skaling et al. | 73/73 |
| 4,137,931 | 2/1979 | Hasenbeck | 137/78 |
| 4,142,411 | 3/1979 | Deal | 73/155 |
| 4,316,386 | 2/1982 | Kerekes | 73/15 |
| 4,348,897 | 9/1982 | Krauss-Kalweit | 73/155 |
| 4,442,895 | 4/1984 | Lagus et al. | 166/250 |
| 4,505,155 | 3/1985 | Jackson | 73/151 |
| 4,802,359 | 2/1989 | Patrice | 73/151 |
| 5,337,601 | 8/1994 | Becker et al. | 73/155 |
| 5,400,858 | 3/1995 | Blanchard et al. | 166/370 |
| 5,420,517 | 5/1995 | Skaling et al. | 324/643 |
| 5,481,927 | 1/1996 | Hubbell et al. | 73/863.71 |
| 5,622,450 | 4/1997 | Grant, Jr. | 405/128 |
| 5,644,947 | 7/1997 | Hubbell et al. | 73/73 |
| 5,646,537 | 7/1997 | Skaling et al. | 324/643 |

*Primary Examiner*—Hezron Williams
*Assistant Examiner*—J. David Wiggins
*Attorney, Agent, or Firm*—Wells St John Roberts Gregory & Matkin

[57] ABSTRACT

A method of measuring a parameter in a well, under isobaric conditions, including such parameters as hydraulic gradient, pressure, water level, soil moisture content and/or aquifer properties the method as presented comprising providing a casing having first and second opposite ends, and a length between the ends, the casing supporting a transducer having a reference port; placing the casing lengthwise into the well, second end first, with the reference port vented above the water table in the well; and sealing the first end. A system is presented for measuring a parameter in a well, the system comprising a casing having first and second opposite ends, and a length between the ends and being configured to be placed lengthwise into a well second end first; a transducer, the transducer having a reference port, the reference port being vented in the well above the water table, the casing being screened across and above the water table; and a sealing member sealing the first end. In one embodiment, the transducer is a tensiometer transducer and in other described embodiments, another type transducer is used in addition to a tensiometer.

19 Claims, 7 Drawing Sheets

ISOBARIC GROUNDWATER WELL

CONTRACTUAL ORIGIN OF THE INVENTION

The United States has rights in this invention pursuant to Contract No. DE-AC07-94ID13223 between the U.S. Department of Energy and Lockheed Martin Idaho Technologies Company.

TECHNICAL FIELD

The invention relates to wells. More particularly, the invention relates to methods and apparatus for measuring groundwater levels and obtaining tensiometer readings in wells or boreholes.

BACKGROUND OF THE INVENTION

Groundwater level data from monitoring wells or boreholes are used for various purposes. For example, groundwater level data is used to determine magnitude and direction of hydraulic gradient at underground storage tanks sites, remedial investigation sites as required by environmental laws, and other sites effected by local and federal regulations. Changes in atmospheric pressure (barometric pressure) cause water levels to rise and fall within the wells. Variations in groundwater levels due to barometric pressure effects have the potential to give false readings. This can result in miscalculations of various items such as hydraulic gradients and flow directions, points of exposure, aquifer properties, and time to exposure from contaminated sites. The term "well" as used herein and in the appended claims, is intended to also encompass boreholes, such as boreholes used with tensiometers.

The effects of barometric fluctuations on water tables are well documented. Barometric pressure changes can cause changes of up to one foot in measured water level versus actual water level. Barometric pressure fluctuations in the atmosphere can significantly impact water table levels within wells.

Increases in barometric pressure cause declines in water levels and vice versa. The mechanisms in causing these effects are: (1) mechanical loading of the aquifer due to the surface load; (2) pressurization at the water surface of the open well due to the air load; (3) flow of the air between the earth's surface and the water table; (4) flow of groundwater between the water table and the aquifer; and (5) flow of groundwater between the aquifer and well.

A confined aquifer is one in which clay, or a confining bed of some other material, impedes upward movement of water. Water underneath the confining bed may be under pressure. In contrast, in an unconfined aquifer, water can rise relatively freely in the geologic material.

Changes in barometric pressure effect changes in water level in unconfined aquifers. The reason why changes in barometric pressure effect changes in water level in unconfined aquifers is as follows. The finite permeability of the unsaturated zone causes a lag in the transfer of the barometric fluctuations to the water table. Because the fluctuations are immediately transferred to the water table in a well, a pressure imbalance occurs between water in the well and water in the aquifer. This pressure imbalance produces the water level fluctuations in the well. After a step change in barometric pressure, only a portion of the change reaches the water table through the unsaturated zone. The difference between the barometric pressure change and the pressure transferred to the water table results in the change in the water table. In time, the water level in the well recovers to the level in the aquifer. Changes in barometric pressure can effect water level measurements in either confined or unconfined wells.

Several numerical solutions to adjust for effects of barometric pressure changes have been proposed. The numerical solutions require knowledge of the soil air diffusivity between land surface above the well and the water table. The diffusivity changes with soil water content which, in turn, changes over time. This error in water level measurements effects the determination of direction of groundwater flow, and the calculated rate of water travel. This error also makes it difficult to determine if water levels have changed, and can affect results of pumping tests so severely that resulting data cannot be properly analyzed.

Many of the prior art methods used to account for barometric effects on the water table use a concept known as barometric efficiency. Barometric efficiency is defined as the fraction of the change in barometric pressure that is instantaneously transmitted to the liquid in the aquifer. The barometric efficiency is calculated as the ratio of the change in the water level in a well compared to the change in atmospheric pressure.

One prior art method of determining average barometric efficiency for an aquifer comprises plotting a sum of incremental changes in the water table versus a sum of incremental changes in barometric pressure, following a number of rules. This method assumes that a single number can be used as an estimate for the barometric efficiency for the entire aquifer. However, barometric efficiency has been found to be related to the frequency of a barometric pressure signal.

Another method comprises performing a frequency domain analysis to correct water table signals in confined and unconfined aquifers to account for the fluctuations due to barometric pressure. A best fit method of barometric efficiency and sine wave frequencies is employed to correct data. The transfer function is assumed for the observed frequency response, the function is multiplied by Fourier transform of the atmospheric record, the result is inverted into the time domain, and a water level time series is subtracted. Assumptions and approximations are used in these methods. Therefore, only approximate water table values can be found. Another prior art method uses a convolution in the time domain as an alternative to the frequency domain analysis to remove barometric effects from measurements in confined aquifers. The time domain solution is derived from an inverse Fourier transform of frequency response function.

The numerical solutions are inadequate because there is a lag time between the pressure change of the atmosphere and the pressure in the soil column immediately above the water table.

BRIEF DESCRIPTION OF THE DRAWINGS

Preferred embodiments of the invention are described below with reference to the accompanying drawings, which are briefly described below.

FIG. 6 illustrates an alternative sealing member which employs a screw on cap.

FIG. 7 illustrates an alternative sealing member which employs an inflatable packer.

FIG. 9 illustrates another alternative sealing member which employs a blind flange.

SUMMARY OF THE INVENTION

Figure 1:
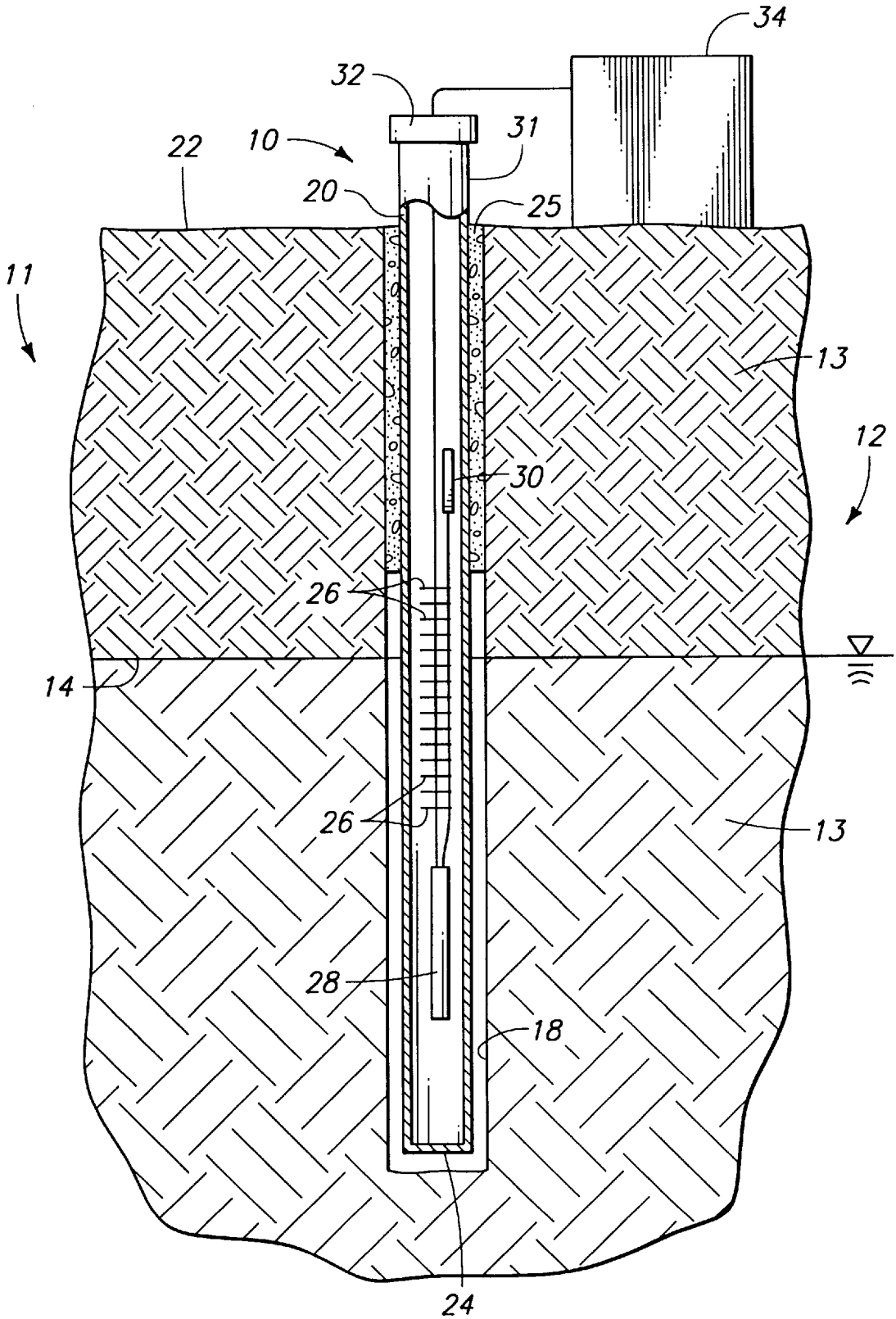
FIG. 1 illustrates a groundwater well in accordance with one embodiment of the invention.

The invention relates to methods of an apparatus for accurately measuring parameters (such as pressure or water level) in wells free from effects of changes in atmospheric pressure (barometric pressure). The invention has application with respect to any type of well, including monitoring wells, pumping wells for a water supply, wells for testing, wells for determining contaminate movement properties, bores for tensiometers, etc.

The invention provides a method of measuring a parameter (such as pressure or water level) in a well under isobaric conditions. The method comprises providing a casing having first and second opposite ends, and a length between the ends. The casing supports a pressure transducer having a reference port. The casing is placed lengthwise into the well, second end first, with the reference port vented in the well, and the first end is sealed.

Another aspect of the invention provides a system for measuring a parameter (such as pressure or water level) in a well under isobaric conditions. The system comprises a casing having first and second opposite ends, and a length between the ends. The casing is configured to be placed lengthwise into a well, second end first. The system further comprises a pressure transducer supported by the casing. The pressure transducer has a reference port. The reference port is vented in the well. A sealing member seals the first end.

Another aspect of the invention provides a system for measuring a parameter in a groundwater well from above ground surface, substantially free from effects of changes in atmospheric pressure. The system comprises a hollow elongated casing having an open end, and a closed end, and being configured to be placed closed end first into a well having a water level, with the closed end below the water level and the open end above the water level. The casing has a wall extending between the open end and the closed end. The wall includes perforations between the open end and the closed end for entry of water from the well into the casing. The system further comprises a pressure transducer in the casing, between the first perforation and the closed end. The pressure transducer has a reference pressure port. The system further comprises an electrical cable coupled to the pressure transducer and configured to transmit pressure readings. The electrical cable extends from the pressure transducer to above ground surface via the open end. A tube is coupled to the reference pressure port of the pressure transducer. The tube is vented above the water level. A sealing member seals the open end while permitting the electrical cable to pass through the open end.

Another aspect of the invention provides a system for measuring a parameter (such as pressure or water level) in a well. The system comprises a casing having first and second opposite ends, and a length between the ends and being configured to be placed into a well having a water level, with the second end below the water level and the first end above the water level. The system comprises a pressure transducer in the casing, the pressure transducer having a reference pressure port. The system further comprises a tube coupled to the reference pressure port of the pressure transducer, the tube being vented above the water level, and a sealing member sealing the first end.

Another aspect of the invention provides a method of measuring a parameter in a groundwater well from above ground surface, substantially free from effects of changes in atmospheric pressure. The method comprises providing a hollow elongated casing having an open end and a closed end, and a wall extending between the open end and the closed end. The wall includes perforations between the open end and the closed end for entry of liquid from the well into the casing. The casing is placed closed end first into a well having a water level, with the closed end below the water level and the open end above the water level. A pressure transducer is provided. The pressure transducer has a reference pressure port. An electrical cable is coupled to the pressure transducer for transmission of electrical signals representing readings from the transducer. A tube is coupled to the reference pressure port of the pressure transducer. The pressure transducer is placed in the casing, between the first perforation and the closed end, with the electrical cable extending from the pressure transducer to above ground surface via the open end, and with the tube being vented between the open end and closed end, and above the water level. The open end is sealed while permitting the electrical cable to pass through the open end.

Another aspect of the invention provides a method of measuring a parameter in a groundwater well from above ground surface. The method comprises providing a casing having first and second opposite ends, and a length between the ends and being configured to be placed lengthwise into a well having a water level, with the second end below the water level and the first end above the water level. The casing is placed lengthwise into a well having a water level, with the second end below the water level and the first end above the water level. A pressure transducer is provided, the pressure transducer having a reference pressure port. A tube is coupled to the reference pressure port of the pressure transducer. The pressure transducer is placed below the water level, with the tube being vented above the water level, and the first end is sealed. In one embodiment, the pressure transducer is included in a tensiometer.

DETAILED DESCRIPTION OF THE PREFERRED EMBODIMENTS

This disclosure of the invention is submitted in furtherance of the constitutional purposes of the U.S. Patent Laws to promote the progress of science and useful arts (Article 1, Section 8).

FIG. 1 shows a system 10 for monitoring a parameter in a groundwater well 11. The system 10 is designed to impede effects of barometric pressure changes on pressure measurements taken from the well 11. The system 10 is shown in FIG. 1 as being located in an unconfined aquifer 12 formed of geologic material 13. The well 11 is a pumping well for a water supply, a testing well such as a well for monitoring contaminant movement or other properties, or any other groundwater well. Water level (the top of the water table) in the aquifer 12 is indicated by reference numeral 14. The well 11 is formed by digging or drilling a bore or hole 18 into the geologic material 13, to a depth below the water level 14.

The system 10 includes a tube or casing 20. The tube or casing prevents the bore hole from collapsing. The casing 20 has a top or upper end 31, a bottom or lower end 24, and a length in the direction between the top 31 and bottom 24. The casing 20 is placed lengthwise into the bore so as to extend from above land surface 22 to below the water level 14. The casing 20 is formed of any material appropriate for groundwater wells, such as plastic, steel, or fiberglass. The bottom 24 of the casing 20 is generally sealed. Voids around the casing 20 are filled. More particularly, fill material 25 such as sand, gravel, concrete or bentonite is placed in the bore 18 around the casing 20 to connect the casing 20 to the geologic material. In the embodiment shown in FIG. 1, a plurality of slots, perforations, or apertures 26 are cut or constructed in the casing 20 making it a screened portion of the well, such as by a star wheel perforator, at locations along the length of the casing 20 such that there are slots 26 at, above, and below the water level 14. Other screen type materials may be used such as continuous-slot, louvered, or bridge-slot. If the casing 20 is slotted right above the water table, pressure from air in the casing 20 is the same as pressure in the geologic material immediately above the water level 14. All of the pressure measured inside the casing 20 is from outside the casing 20 when the casing is sealed from the atmosphere by seal 32.

The screens provide a conduit for fluid traveling from the geologic material 13 into the casing 20.

The system 10 further includes a pressure transducer (or sensor) 28 in the casing 20, below the water level 14 and the slots 26, for measuring a parameter in the well. In the illustrated embodiment, the transducer is an electronic pressure transducer. The transducer 28 can be any pressure transducer appropriate for use in wells. One example of a transducer that could be employed is a Series 1830 transducer available from Druck Incorporated, 4 Dunham Drive, New Fairfield, Conn. 06812. Another example of a transducer that could be employed is model number PXD-260 available from In-Situ, 210 South Third Street, P.O. Box 1, Laramie, Wyo. 82070. Yet another example is a Series 300 available from Keller PSI, 530 Vista Bella, Suite 111, Oceanside, Calif. 92057. The transducer 28 measures pressure relative to a reference pressure provided at a backside or reference port of the transducer (not shown). The transducer 28 backside or reference port is coupled to a hollow tube. The hollow tube is normally taken up above the land surface 22. The system further includes an electrical cable including conductors coupling the pressure transducer 28 to a conventional data logger 34 above land surface 22. The data logger 34 periodically records measurements taken by the transducer 28. The hollow tube is normally vented inside the data logger 34 in prior art designs and logger 34 is vented to the atmosphere. However, in the system 10 of the illustrated embodiment, the hollow tube is vented inside the casing 20 at a location 30 above the water level 14. The vent location 30 may include a desiccant to protect the backside of the transducer 28 from moisture. The hollow tube is vented above the water level 14. In prior art designs, the casing 20 is normally not sealed from land surface 22. However, in the system 10 of the illustrated embodiment, the top or upper end 31 of the casing 20 is sealed. More particularly, in the illustrated embodiment, the system 10 further includes a cap or sealing member 32 sealing the top of the casing 20. Various alternative sealing members can be employed for sealing the top of the casing 20. Some alternative sealing members will be described below in connection with FIGS. 3–9. There are numerous way to seal the well—these are just a few. Other is types of seals can be employed. What is important is that the top be substantially sealed against air leaks. There are some prior art well caps that form a seal, but these provide a sanitary seal, to prevent water, bugs, and small animals from falling into the well. These prior art seals do not seal out air. Air leaks are not significant to the prior art designs.

In the embodiment of FIG. 1, the well has been screened across the water table by slots 26. Because the screen 26 is open across the water table, and the casing 20 is sealed at land surface, the pressure inside the casing 20 is equivalent to the air pressure in the geologic material 13 adjacent to the well screen and immediately above the water level 14. This allows the vent to the backside of the pressure transducer 28 to be open anywhere in the casing 20 (above the water table). Other screening arrangements are possible. One alternative screening arrangement is shown in FIG. 2

Figure 2:
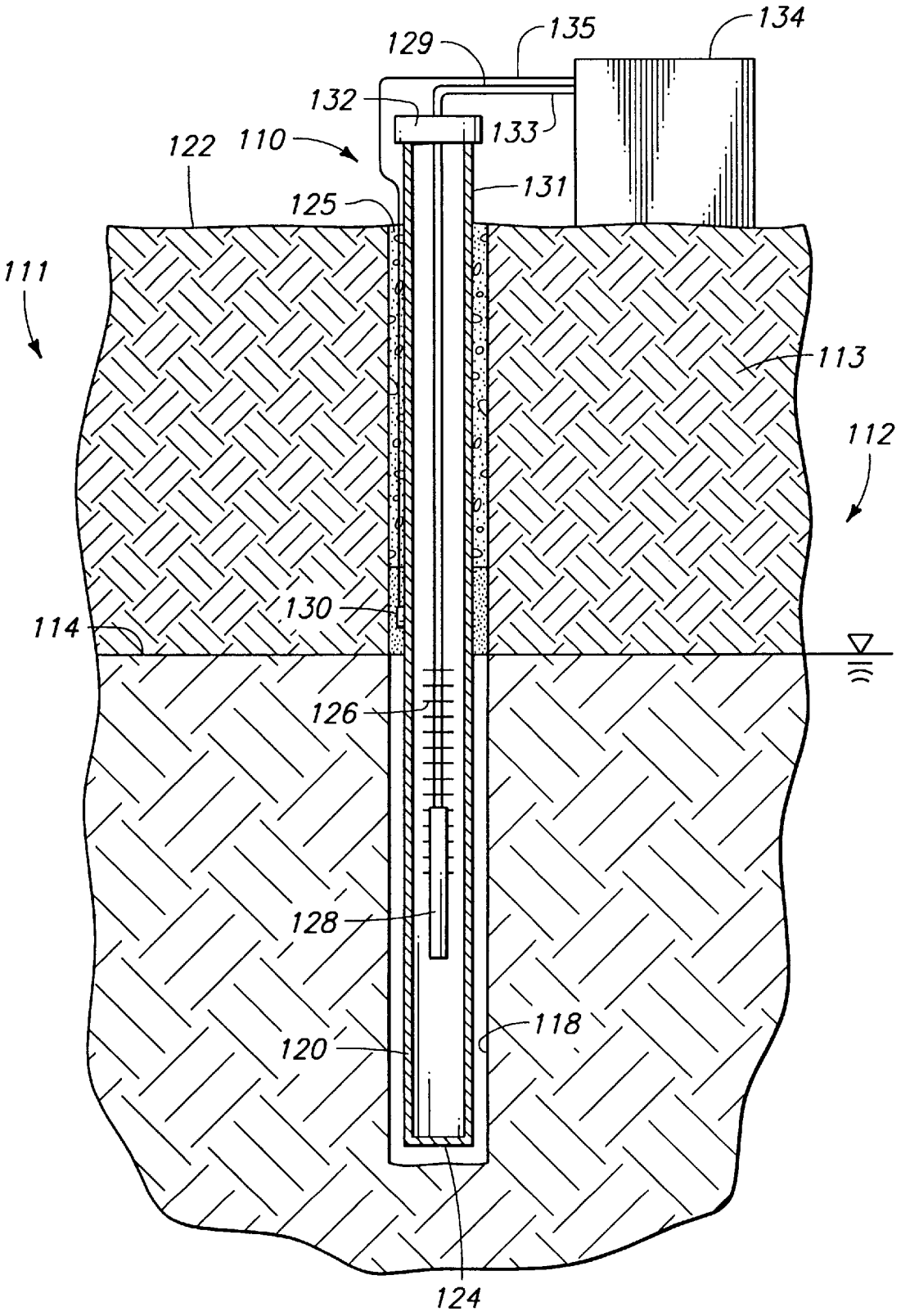
FIG. 2 illustrates a groundwater well in accordance with an alternative embodiment of the invention.

FIG. 2 shows a system 110 in accordance with an alternative embodiment of the invention for measuring a parameter in a groundwater well 111. The system 110 is similar to the system 10 of FIG. 1 except for screen location, and arrangement of the vent to the reference port of the transducer. Like the system 10, the system 110 is also designed to remove or correct effects of barometric pressure changes on pressure measurements taken from the well 111. The well 111 is shown in FIG. 2 as being located in an unconfined aquifer 112 formed of geologic material 113. Water level (the top of the water table) in the aquifer 112 is indicated by reference numeral 114. The well 111 is formed by digging or drilling a bore or hole 118 into the geologic material 113, to below the water level 114.

The system 110 includes a tube or casing 120. The casing 120 has a top or upper end 131, a bottom or lower end 124, and a length in the direction between the top 131 and bottom 124. The casing 120 is placed lengthwise into the bore 118 so as to extend from above land surface 122 to below the water level 114. The casing 120 is formed of plastic, steel, or fiberglass. The casing 120 has a sealed bottom 124. Fill material 125 such as sand, gravel, concrete or bentonite is placed in the bore 118 around the casing 120 to connect the casing 120 to the geologic material 113. A plurality of slots, perforations, or apertures 126 are included in the casing 120, at locations along the length of the casing 120. The perforations may be pre-formed in the casing 120, or cut such as by a star wheel perforator. Other forms of screens that may be employed include louvered screens, bridge-slot screens, pipe-base screens, slotted plastic pipe, wire wrapped screens, or other screen types known in the art. Most casings are pre-built (already screened) and ready for installation.

The system 110 further includes a pressure transducer 128 in the casing 120, below the water level 114. The transducer 128 has a backside or reference port (not shown) coupled to a hollow tube 129. The hollow tube 129 is taken up above the land surface 122 outside the casing 120. More particularly, the conductors for the transducer 128 and the tube 129 are together included in a common conduit or in insulation extending inside the tube 129 from the transducer 128 to outside the well. The pressure transducer 128 is coupled to a conventional data logger 134 above land surface 122 (e.g., by a coax or shielded two lead cable 133). The data logger 134 periodically records measurements taken by the transducer 128. The hollow tube 129 is normally vented inside the data logger 134 and the logger 134 is vented to the atmosphere in prior art designs. However, in the system 110 of the embodiment illustrated in FIG. 2, the hollow tube is coupled to another tube 135 vented at a gas pressure port, outside the casing 120, at a location 130 above the water level 14. In the illustrated embodiment, the location 130 is above the water level 114. The casing 120 has an upper end 131 which is sealed. More particularly, in the illustrated embodiment, the system 110 further includes a cap or sealing member 132 sealing the top of the casing 120. Various alternative sealing members can be employed for sealing the top of the casing 120. Several alternative sealing members will be described below in connection with FIGS. 3–9.

The slots 126 defining the screen in the casing 120 provide a conduit for fluid traveling from the geologic material 113 into the well 110. FIG. 2 shows a screen arrangement that is an alternative to the screen arrangement of FIG. 1. In the embodiment of FIG. 2, the screen 126 for the well is placed below the water table. Because the pressure in the well is not the same as the pressure in the surrounding geologic formation immediately above the water table, a gas pressure port 130 is needed at this location (on the outside of the casing) to allow the pressure on the backside of the pressure transducer to be the same as the pressure in the geologic material immediately above the water table. The location of the screen 116 could be above or below the water table depending on requirements of the well, but to remove the effects of changes in atmospheric pressure, there is a need to provide the air pressure above the water table to the backside of the transducer 128. Permeable material 140, such as sand or gravel, is backfilled next to the vent 130. The closer the vent to the water table, the better the correlation. Thus, venting close to the water table provides better readings; however, the vent should not be so close to the water table that the water table may rise over the vent. The well design of FIG. 2 is similar to that described in U.S. Pat. No. 5,481,927 to Hubbell et al. (incorporated herein by reference) but modified as described herein.

An advantage of the embodiment of FIG. 2 is that a conduit containing both the cable and backside reference tube 129 for the transducer 128 can be taken to land surface 122. In accordance with the embodiment of FIG. 2, another tube 135 vented to outside the casing 120 is coupled to the tube 129 and attached to the reference side of the pressure transducer 128.

Various alternative sealing members can be employed for sealing the top of the casing 120. Several of these alternative sealing members will now be described, reference being made to FIGS. 3–9.

Figure 3:
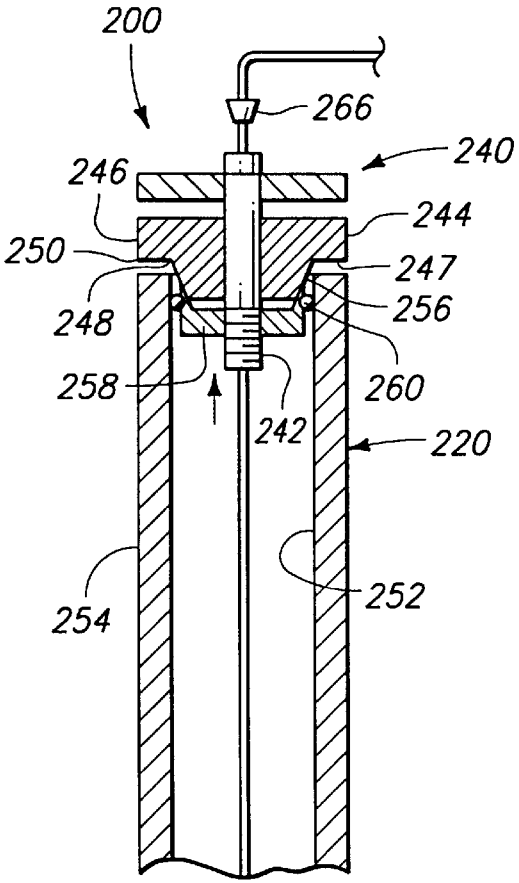
FIG. 3 illustrates a sealing member for the well of FIG. 1 or the well of FIG. 2 in accordance with one embodiment of the invention.

FIG. 3 shows a sealing member 200 for sealing the top of a casing 220. The casing 220 is substantially similar to the casing 120 or the casing 20. The sealing member 200 comprises a test plug, such as is available from Sioux Chief Manufacturing. More particularly, the sealing member 200 includes a tightening piece 240 including a central, threaded, cylindrical piece 242. The sealing member 200 further includes a wedge piece 244 having a central aperture through which the cylindrical piece 242 passes. The wedge piece 244 includes a lip portion 246 having an annular face 247 facing the top of the casing 220. The annular face 247 has inner and outer diameters 248 and 250 overlapping or corresponding to the inner and outer diameters 252 and 254 of the casing 220. The wedge piece 244 further includes a frustum portion 256 depending from the lip portion 246 and sized to fit into the casing 220. In the illustrated embodiment, the wedge piece 244 is formed of metal or non-deformable plastic.

The sealing member 200 further includes a deformable mating piece 258 having a shape that mates with the frustum portion 256 and that spreads radially outwardly when pulled against the frustum portion 256. The mating piece 258 is formed of a semi-rigid plastic, for example polyethylene, polypropylene, thermoplastic elastomers, or nylon. There may be other plastics that are acceptable. The mating piece 258 further includes a circumferentially extending groove which receives an o-ring or gasket 260. The o-ring 260 is pushed against the inner diameter 252 of the casing 220 when the mating piece 258 is pulled against the wedge piece 244. The mating piece 258 includes a threaded central aperture engaged by the threaded cylindrical piece 242 and is drawn to the wedge piece when the tightening piece 240 is tightened relative to the wedge piece 244. The transducer cable (FIG. 1 embodiment) or the transducer cable and tube (FIG. 2 embodiment) pass through the sealing member 200 so as not to provide a path for air to pass into the casing. For example, the cable (or cable and tube) pass through an aperture in the sealing member 200, and a seal is then provided such as by using epoxy, caulk, a one holed stopper, a compression fitting, etc. In one embodiment, the cable and reference tubes pass through the cylindrical piece 242. In the illustrated embodiment, the cable (or cable and tube) pass through an aperture in a one holed stopper 266 (e.g., formed of rubber or neoprene) which is tightly fitted in an aperture through the sealing member 200. In an alternative embodiment, additional apertures are provided, so as to provide for water level measurement. These apertures can also be sealed using a stopper or other means.

Figure 4:
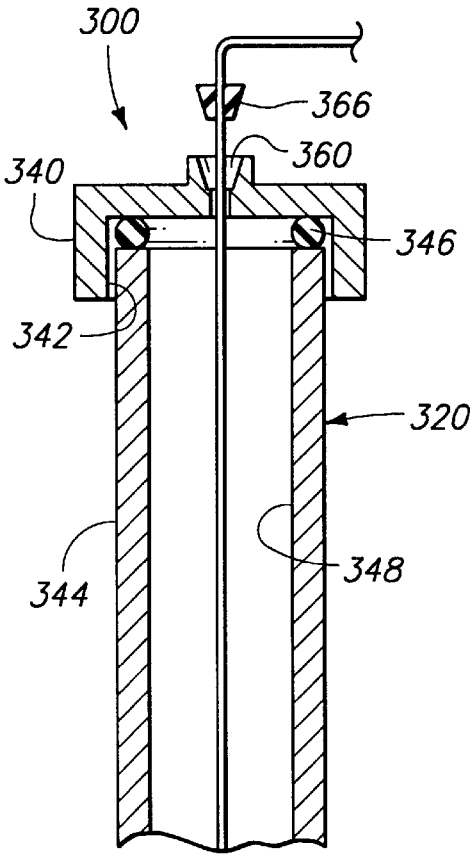
FIG. 4 illustrates an alternative sealing member for the well of FIG. 1 or the well of FIG. 2, which employs a compression fitting.

FIG. 4 shows an alternative sealing member 300, for sealing the top of a casing 320. The casing 320 is substantially similar to the casing 120 or the casing 20 and has an outer surface 344 having an outer diameter, and an inner surface 348 having an inner diameter. The sealing member 300 includes a compression fitting 340 having an inner diameter 342 slightly greater than the outer diameter of the outer surface 344 of casing 320 to cap the top of the casing 320. The sealing member 300 further includes an o-ring (or flat membrane) 346 having inner and outer diameters corresponding to or overlapping the inner and outer diameters of the inner and outer surfaces 344 and 348. The compression fitting 340 is weighted or made of metal so as to compress the o-ring 342 and create a seal. The transducer cable (FIG. 1 embodiment) or the transducer cable and tube (FIG. 2 embodiment) pass through the sealing member 300 so as not to provide a path for air to pass into the casing. For example, the cable (or cable and tube) pass through an aperture 360 in the sealing member 300, and a seal is then provided such as by using epoxy, caulk, a one holed stopper, a compression fitting, etc. In the illustrated embodiment, the cable (or cable and tube) pass through an aperture in a one holed stopper 366 (e.g., formed of rubber or neoprene) which is tightly fitted in the aperture 360. In an alternative embodiment, additional apertures are provided, so as to provide for water level measurement. These apertures can also be sealed using a stopper or other means.

Figure 5:
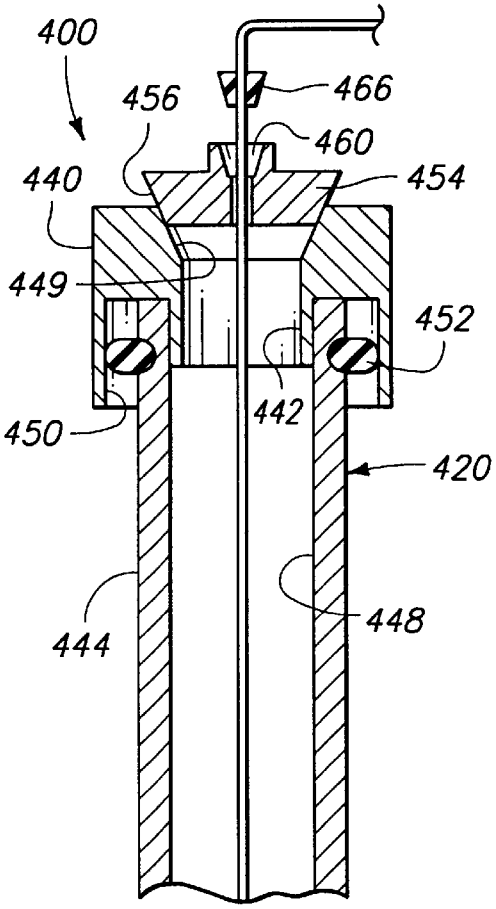
FIG. 5 illustrates an alternative sealing member which employs a weighted cap.

FIG. 5 shows another alternative sealing member 400, for sealing the top of a casing 420. The casing 420 is substantially similar to the casing 120 or the casing 20 and has an outer surface 444 having an outer diameter, and has an inner surface 448 having an inner diameter. The sealing member 400 includes a weighted sleeve 440 which slidingly engages the top of the casing 420. The sleeve 440 includes an inner aperture which includes a cylindrical portion 442 having a diameter less than the inner diameter of the inner surface 448, and includes an upper portion that is tapered or flared outwardly in the direction upward from the cylindrical portion 442. The sleeve 440 further includes an inner cylindrical surface 450 having a diameter greater than the diameter of the outer surface 444. The sleeve 440 is sealed to the casing 420 by gasket, threads, or any other means. In the illustrated embodiment, the sleeve 440 includes an o-ring 452 closely surrounding the outer surface 444 of the casing 420 and closely surrounded by the inner cylindrical surface 450 so as to provide a seal between the outer surface 444 and the inner cylindrical surface 450. The sealing member 400 further includes a weighted cap 454 including a tapered surface 456 complementary to the upper portion 449 of the sleeve 440. The cap 454 may have gasket material. The cap 454 is removable from the sleeve 440. The transducer cable (FIG. 1 embodiment) or the transducer cable and tube (FIG. 2 embodiment) pass through the sealing member 400 so as not to provide a path for air to pass into the casing. For example, the cable (or cable and tube) pass through an aperture in the sealing member 400, and a seal is then provided such as by using epoxy, caulk, a one holed stopper, a compression fitting, etc. In one embodiment, the cable (or cable and tube) pass through a central aperture 460 in the cap 454. In the illustrated embodiment, the cable (or cable and tube) pass through an aperture in a one holed stopper 466 (e.g., formed of rubber or neoprene) which is tightly fitted in the aperture 460. The arrangement of FIG. 5 provides for easy access to the interior of the casing 420.

FIG. 6 shows another alternative sealing member 500, for sealing the top of a casing 520. The casing 520 is substantially similar to the casing 120 or the casing 20 and has an outer surface 544 having an outer diameter, and has an inner surface 548 having an inner diameter. In the embodiment of FIG. 6, the outer surface 544 has threads 550 proximate the top of the casing 520. The sealing member 500 includes a cap or piece 552 having an inner surface 554 with threads 556 that are complementary to the threads 550, so the cap 552 threadingly mates with the top of the casing 520. Preferably, teflon tape or thread sealant is placed between the cap 552 and the outer surface 544. The transducer cable (FIG. 1 embodiment) or the transducer cable and tube (FIG. 2 embodiment) pass through the sealing member 500 so as not to provide a path for air to pass into the casing. For example, the cable (or cable and tube) pass through an aperture in the sealing member 500, and a seal is then provided such as by using epoxy, caulk, a one holed stopper, a compression fitting, etc. In one embodiment, the cable (or cable and tube) pass through a central aperture 560 in the cap 552. In the illustrated embodiment, the cable (or cable and tube) pass through an aperture in a one holed stopper 566 (e.g., formed of rubber or neoprene) which is tightly fitted in the aperture 560. In an alternative embodiment, additional apertures are provided, so as to provide for water level measurement. These apertures can also be sealed using a stopper or other means.

FIG. 7 shows another alternative sealing member 600, for sealing a casing 620. The casing 620 is substantially similar to the casing 120 or the casing 20 and has an outer surface 644 having an outer diameter, and has an inner surface 648 having an inner diameter. The sealing member 600 includes an inflatable packer or bladder 650 inserted into the casing 620 and inflated to seal the casing 620. The packer or bladder 650 can be anywhere in the casing 620 as long as it is above the screen (above the water table). The transducer cable (FIG. 1 embodiment) or the transducer cable and tube (FIG. 2 embodiment) pass around or through the sealing member 600 so as not to provide a path for air to pass into the casing. For example, the cable (or cable and tube) pass through an aperture in the sealing member 600, and a seal is then provided such as by using epoxy, caulk, a one holed stopper, a compression fitting, etc. In one embodiment, the cable (or cable and tube) pass between the packer 650 and the inner surface 648.

Figure 8:
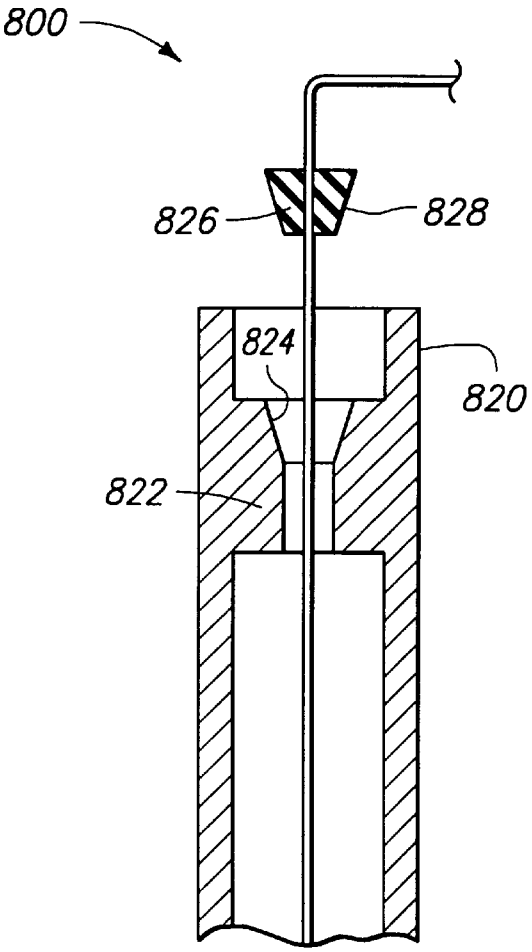
FIG. 8 illustrates an alternative sealing member which is a variation of the sealing member of FIG. 5.
Figure 10:
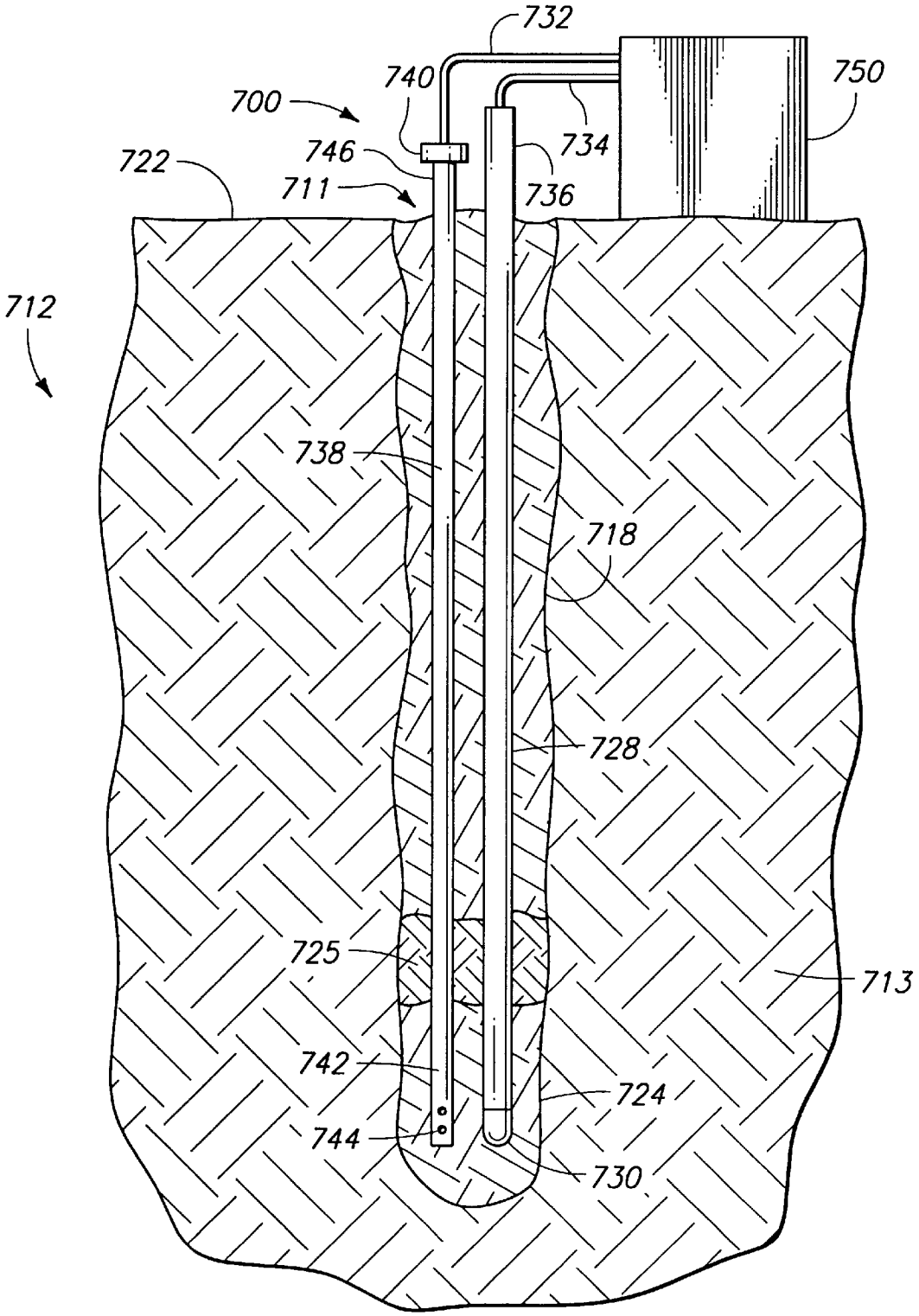
Figure 11:
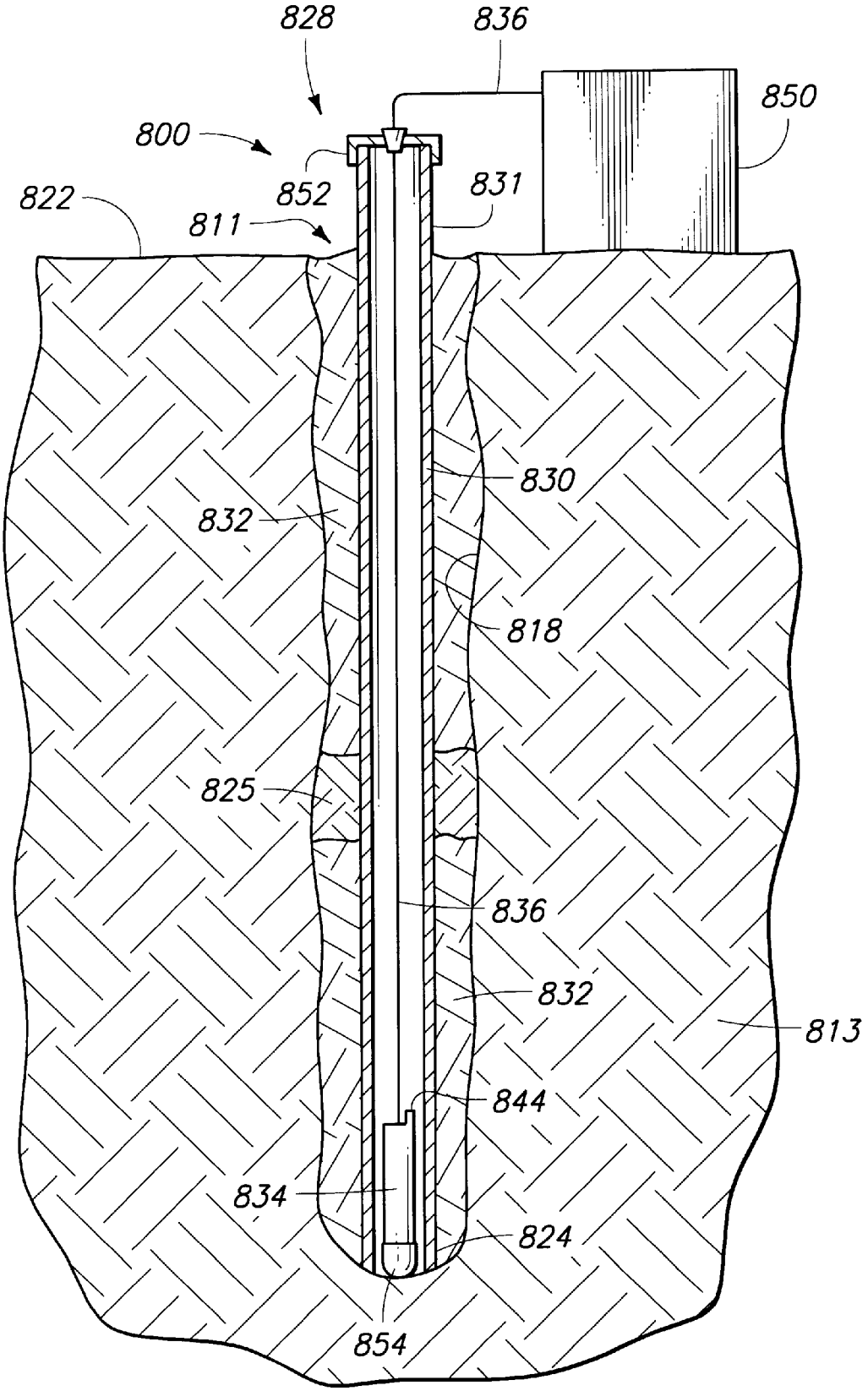

FIG. 8 shows another alternative sealing member 800, for sealing a casing 820. The casing 820 is different from the casing 120 or the casing 20 and has a reduced diameter portion 822 including an upper tapered portion 824. The sealing member 800 includes a cap or member 826 that has a tapered exterior surface 828 that is complementary to the tapered surface portion 824.

FIG. 9 shows another alternative sealing member 900, for sealing the top of a casing 920. The casing 920 is substantially similar to the casing 120 or the casing 20 and has an outer surface 944 having an outer diameter, and has an inner surface 948 having an inner diameter. In the embodiment of FIG. 9, an annular flange 952 is welded to or otherwise formed in the top of the casing 920. The flange 952 includes bolt-holes 954. The sealing member 900 includes a plate 956 having a diameter at least as large as the diameter of the flange 952, and including bolt holes 957 capable of alignment with the bolt holes 954 of the flange 952. The sealing member 900 further includes an annular gasket 958 having inner and outer diameters selected to provide a seal between the plate 956 and the flange 952, and further having bolt holes 960 capable of alignment with the bolt holes 954. The sealing member 900 further includes bolts 962 or other fasteners for fastening the plate 956 to the flange 952 with the gasket 958 disposed between the plate 956 and flange 952. The sealing member 900 further includes an aperture 964 for passing the transducer cable (FIG. 1 embodiment) or the transducer cable and tube (FIG. 2 embodiment), and a secondary seal so as not to provide a path for air to pass into the casing. For example, a seal is provided such as by using epoxy, caulk, a compression fitting, etc. In the illustrated embodiment, the cable (or cable and tube) pass through an aperture in a one holed stopper 966 (e.g., formed of rubber or neoprene) which is tightly fitted in the aperture 964. In an alternative embodiment, additional apertures are provided, so as to provide for water level measurement. These apertures can also be sealed using a stopper or other means.

Figure 10:
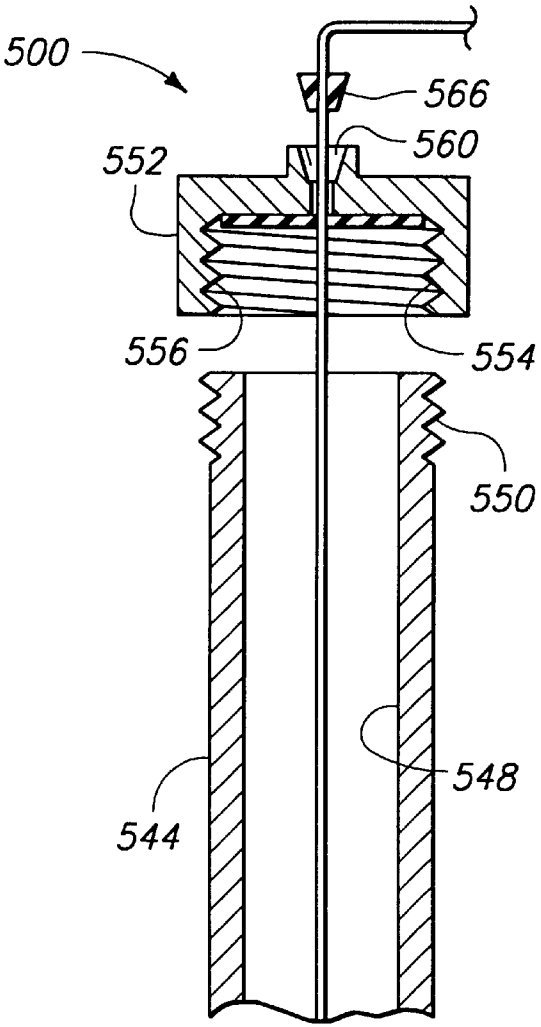
FIG. 10 illustrates a groundwater well including a tensiometer in accordance with one embodiment of the invention.
Figure 11:
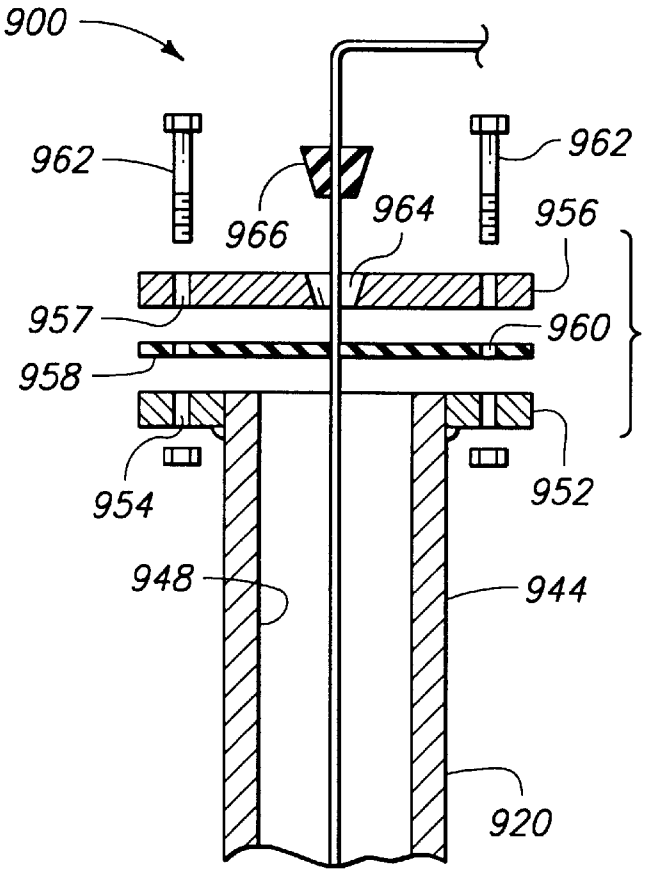

FIG. 10 shows a system 700 for monitoring a parameter in a borehole or well 711. More particularly, FIG. 10 illustrates a system including a tensiometer 728. The system 700 is designed to correct effects of atmospheric pressure changes on tensiometer measurements taken from the well 711. Tensiometers are known in the art. Tensiometers measures how tightly water is held to soil. Such readings are useful, for example, for farmers who wish to determine when to irrigate. The system 700 is shown in FIG. 10 as being located in geologic material 713. The borehole 711 is formed by digging or drilling a bore or hole 718 into the geologic material 713, to a desired depth at which tensiometer readings are to be taken. The tensiometer 728 includes a porous ceramic tip or zone 730, a vent line 732, and a cable 734. The tensiometer 728 has a top 736 and a length between the tip 730 and the top 736. The vent line 732 extends from the reference side of a transducer or gauge included in the tensiometer 728 to above land surface 722.

In the illustrated embodiment, the system 700 further includes a vent line housing or tube 738 receiving the vent line 732. The tube 738 has a top end 740 that is sealed around the vent line. The housing 738 is formed of any appropriate material such as a plastic material, semi-rigid Teflon, high density polyethylene, etc. The tube 738 has a bottom or lower end 742 having an aperture 744 in fluid communication with the vent line 732. The housing 738 has a top or upper end 746 and a length in the direction between the top 746 and the bottom 744. In the illustrated embodiment, the tube 738 has a diameter of one eighth or one sixteenth inch. In an alternative embodiment, a single line is used instead of using both a vent line 732 and a tube 738 (the vent line 732 is the tube 738) in that case.

The tube 738 is strapped on to the tensiometer, and the housing 738 and the tensiometer 728 are placed lengthwise into the bore so as to extend from above land surface 722 into the bore 718. Voids around the housing 738 and tensiometer 728 are filled. More particularly, voids around the housing 738 and tensiometer 728 are filled with backfill material 724 such as dirt or soil, a layer of fill material 725 such as concrete or bentonite to seal the housing 738 and tensiometer 728 to the geologic material 713, and a further layer of backfill material 724 such as dirt or soil. The system 700 further includes a data logger 750 above ground surface coupled to the tensiometer 728 by the cable 734. The data logger 750 periodically records readings taken by the tensiometer 728. The system 700 permits tensiometer measurements to be taken substantially free of effects from atmospheric pressure changes.

Figure 11:
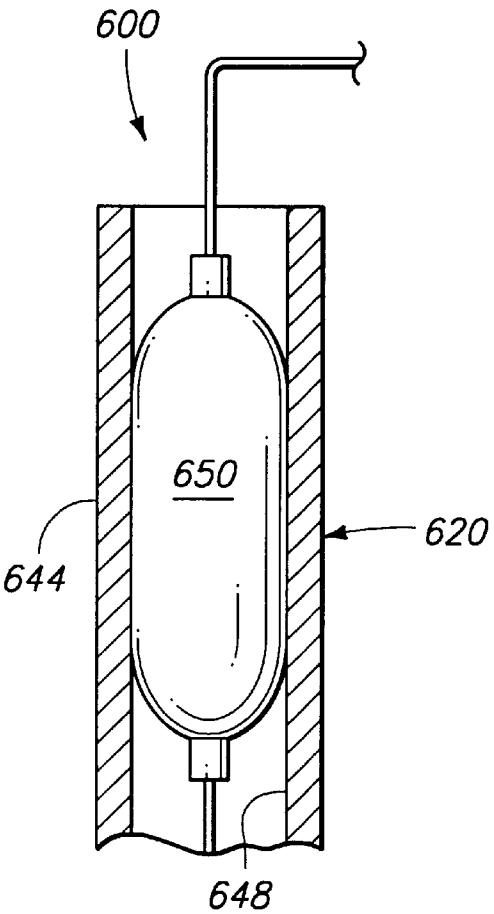
FIG. 11 illustrates a groundwater well including a tensiometer in accordance with another embodiment of the invention.

FIG. 11 shows an alternative, portable, system 800 for monitoring a parameter in a borehole or well 811. More particularly, FIG. 11 illustrates a system including a tensiometer 828 which bears some similarity to a tensiometer disclosed in commonly assigned U.S. Pat. No. 5,644,947, which is incorporated herein by reference. Alternatively, the tensiometer can be similar to one disclose in a U.S. patent application (Attorney Docket LIT-PI-194) titled "Monitoring Well," naming as inventors Joel M. Hubbell and James B. Sisson, and incorporated herein by reference, except modified as described herein. Attention is also directed to a U.S. patent application (Attorney Docket EGG-PI-753) titled "Field Matric Potential Sensor," naming as inventors Joel M. Hubbell and James B. Sisson, and incorporated herein by reference. The system 800, like the system 700, is designed to impede effects of atmospheric pressure changes on tensiometer measurements taken from the well 811. The well 811 is formed by digging or drilling a bore or hole 818 into the geologic material 813, to a desired depth at which tensiometer readings are to be taken. The tensiometer 828 includes a casing 830. The casing 830 has a top or upper end 831, a bottom or lower end 824, and a length in the direction between the top 831 and bottom 824. The casing 830 is placed lengthwise into the bore so as to extend from above land surface 822 to a desired depth where readings are to be taken. The casing 830 is formed of any appropriate material. The bottom 824 of the casing 830 is open. Voids around the casing 830 are filled with backfill material 832 such as dirt or soil, a layer of fill material 825 such as concrete or bentonite around the casing 830 to seal the casing 830 to the geologic material 813, and a further layer of backfill material 832 such as dirt or soil. The tensiometer 828 includes a transducer 834 in the casing 830, a porous ceramic cup (854), a reservoir configured to be filled with water (not shown), a reference or backside port 844 vented in the casing 830, and a cable 836.

The system 800 further includes a cap or sealing member 852 sealing the top of the casing 830. The sealing member could be as simple as a one holed stopper pressed into the top of the casing 830. In alternative embodiments, the sealing members shown in FIG. 3–9 are employed.

The system 800 further includes a data logger 850 above ground surface coupled to the transducer 834 by the cable 836. The data logger 850 periodically records readings taken by the transducer 834. The system 800 permits tensiometer measurements to be taken substantially free of effects from atmospheric pressure changes, using a portable system.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A system for measuring a parameter in a groundwater well from above ground surface, substantially free from effects of changes in atmospheric pressure, the system comprising:

a hollow elongated casing having an open end, and a closed end, and being configured to be placed closed end first into a well having a water level, with the closed end below the water level and the open end above the water level, the casing having a wall extending between the open end and the closed end, the wall including perforations between the open end and the closed end for entry of water from the well into the casing, the casing being threaded proximate the open end, wherein the sealing member comprises a threaded cap selectively mating with the threaded casing to seal the open end of the casing, and wherein the cable sealingly passes through the threaded cap;

a pressure transducer in the casing, the pressure transducer having a reference pressure port;

an electrical cable coupled to the pressure transducer and configured to transmit pressure readings, the electrical cable extending from the pressure transducer to above ground surface via the open end;

a tube coupled to the reference pressure port of the pressure transducer, the tube being vented above the water level in the casing; and a sealing member sealing the open end while permitting the electrical cable to pass through the open end.

2. A system for measuring a parameter in a groundwater well from above ground surface, substantially free from effects of changes in atmospheric pressure, the system comprising:

a hollow elongated casing having an open end, and a closed end, and being configured to be placed closed end first into a well having a water level, with the closed end below the water level and the open end above the water level, the casing having a wall extending between the open end and the closed end, the wall including perforations between the open end and the closed end for entry of water from the well into the casing;

a pressure transducer in the casing, the pressure transducer having a reference pressure port;

an electrical cable coupled to the pressure transducer and configured to transmit pressure readings, the electrical cable extending from the pressure transducer to above the ground surface via the open end;

a tube coupled to the reference pressure port of the pressure transducer, the tube being vented above the water level in the casing; and a sealing member sealing the open end while permitting the electrical cable to pass through the open end, wherein the sealing member comprises an inflatable packer.

3. A system for measuring a parameter in a groundwater well from above ground surface, substantially free from effects of changes in atmospheric pressure, the system comprising:

a hollow elongated casing having an open end, and a closed end, and being configured to be placed closed end first into a well having a water level, with the closed end below the water level and the open end above the water level, the casing having a wall extending between the open end and the closed end, the wall including perforations between the open end and the closed end for entry of water from the well into the casing, the casing being threaded proximate the open end, and wherein the sealing member comprises a threaded cap sealing the open end of the casing;

a pressure transducer in the casing, the pressure transducer having a reference pressure port;

an electrical cable coupled to the pressure transducer and configured to transmit pressure readings, the electrical cable extending from the pressure transducer to above the ground surface via the open end;

a tube coupled to the reference pressure port of the pressure transducer, the tube being vented above the water level in the casing; and a sealing member sealing the open end while permitting the electrical cable to pass through the open end.

4. A system for measuring a parameter in a groundwater well from above ground surface, substantially free from effects of changes in atmospheric pressure, the system comprising:

a hollow elongated casing having an open end, and a closed end, and being configured to be placed closed end first into a well having a water level, with the closed end below the water level and the open end above the water level, the casing having a wall extending between the open end and the closed end, the wall including perforations between the open end and the closed end for entry of water from the well into the casing;

a pressure transducer in the casing, the pressure transducer having a reference pressure port;

an electrical cable coupled to the pressure transducer and configured to transmit pressure readings, the electrical cable extending from the pressure transducer to above the ground surface via the open end;

a tube coupled to the reference pressure port of the pressure transducer, the tube being vented above the water level in the casing; and a sealing member sealing the open end while permitting the electrical cable to pass through the open end, the sealing member comprising a threaded piece.

5. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing, wherein providing the casing comprises providing a casing that is threaded proximate the open end;

placing the casing closed end first into a well having a water level, with the closed end below the water level and the open end above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above ground surface via the open end, and with the tube being vented between the open end and closed end, and above the water level; and sealing the open end while permitting the electrical cable to pass through the open end, wherein sealing the open end comprises passing the cable through a threaded cap, and threading the cap with the threaded casing to seal the open end of the casing.

6. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing;

placing the casing closed end first into a well having a water level, with the closed end below the water level and the open end above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above the ground surface via the open end, and with the tube being vented between the open end and closed end, and above the water level; and sealing the open end while permitting the electrical cable to pass through the open end, wherein sealing the open end comprises employing a threaded piece, and passing the cable through the threaded piece.

7. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing;

placing the casing closed end first into a well having a water level, with the closed end below the water level and the open end above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above the ground surface via the open end, and with the tube being vented between the open end and closed end, and above the water level; and sealing the open end while permitting the electrical cable to pass through the open end, wherein sealing the open end comprises inflating an inflatable packer in the casing.

8. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing;

placing the casing closed end first into a well having a water level, with the closed end below the water level and the open end above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above the ground surface via the open end, and with the tube being vented between the open end and closed end, and above the water level; and sealing the open end while permitting the electrical cable to pass through the open end, wherein sealing the open end comprises placing a seal on the open end, and compressing the seal with a weighted piece.

9. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing, wherein providing the casing comprises providing a casing that is threaded proximate the open end;

placing the casing closed end first into a well having a water level, with the closed end below the water level and the open end above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above ground surface via the open end, and with the tube being vented between the open end and closed end, and above the water level; and sealing the open end while permitting the electrical cable to pass through the open end, wherein sealing the open end comprises threading the cap with the threaded casing to seal the open end of the casing.

10. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing;

placing the casing closed end first into a well having a water level, with the closed end below the water level and the open end above the water level;

providing a pressure transducer the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above the ground surface via the open end, and with the tube being vented between the open end and closed end, and above the water level; and sealing the open end while permitting the electrical cable to pass through the open end, wherein sealing the open end comprises employing a threaded piece.

11. A method in accordance with claim 10 wherein the tube is vented inside the casing.

12. A method of measuring a parameter in a groundwater well from above ground surface, substantially free from effects of changes in atmospheric pressure, the method comprising:

providing a hollow elongated casing having an open end and a closed end, and a wall extending between the open end and the closed end, the wall being screened between the open end and the closed end for entry of liquid from the well into the casing;

placing the casing closed end first into a well having a water level, with the closed end below the water level and the open end above the water level, and wherein geologic material surrounds the casing and includes geologic material above the water level, and wherein the tube is vented outside the casing into the geologic material above the water level;

providing a pressure transducer, the pressure transducer having a reference pressure port;

coupling an electrical cable to the pressure transducer for transmission of electrical signals representing readings from the transducer;

coupling a tube coupled to the reference pressure port of the pressure transducer;

placing the pressure transducer in the casing, with the electrical cable extending from the pressure transducer to above the ground surface via the open end, and with the tube being vented between the open end and closed end, and above the water level; and sealing the open end while permitting the electrical cable to pass through the open end.

13. A system of measuring a parameter in a well, the system comprising:

a casing having first and second opposite ends, and a length between the ends and being configured to be placed lengthwise into a well second end first;

a transducer supported by the casing, and wherein the transducer comprises a pressure transducer having a reference port which is vented in the well; and a sealing member sealing the first end, and wherein geologic material surrounds the casing, and wherein the well has a water table and the casing extends partially below the water table, and wherein the reference port is vented to the geologic material above the water table.

14. A method of measuring a parameter in a well, the method comprising:

providing a casing having first and second opposite ends, and a length between the ends, the casing supporting a transducer having a reference port;

placing the casing lengthwise into the well, second end first, with the reference port vented in the well; and sealing the first end.

15. A method in accordance with claim 14 and for measuring air pressure in the well, and further comprising mathematically subtracting pressure in the casing from a reading by the transducer.

16. A method in accordance with claim 14 and for taking tensiometer readings in the well.

17. A system for measuring a parameter in a groundwater well from above ground surface, substantially free from effects of changes in atmospheric pressure, the system comprising:

a hollow elongated casing having an open end, and a closed end, and being configured to be placed closed end first into a well having a water level, with the closed end below the water level and the open end above the water level, the casing having a wall extending between the open end and the closed end, the wall including perforations between the open end and the closed end for entry of water from the well into the casing, the casing being threaded proximate the open end, and the sealing member including a threaded cap configured to seal the open end of the casing;

a pressure transducer in the casing, the pressure transducer having a reference pressure port;

an electrical cable coupled to the pressure transducer and configured to transmit pressure readings, the electrical cable extending from the pressure transducer to above the ground surface via the open end;

a tube coupled to the reference pressure port of the pressure transducer, the tube being vented above the water level in the casing; and a sealing member sealing the open end while permitting the electrical cable to pass through the open end.

18. A system for measuring the natural level of a water table below the ground surface at a specific location and measuring the natural subterranean air pressure near the water table at the same specific location, the water table having a naturally occurring maximum level and a naturally occurring minimum level, and wherein both the maximum and minimum levels occur within a specific time period during which the natural level of the water table is measured, the measured level of the water table and the subterranean air pressure being free from the effects of any artificially created pressure conditions or naturally occurring variations in local above-ground atmospheric pressure conditions, the system comprising:

a hollow elongated casing which defines a cavity, the casing having a sealable open end and a closed end, the casing having a wall which defines the cavity, the wall having an interior surface and an exterior surface, the wall extending between the sealable open end and the closed end, and which defines a plurality of the wall passages allowing for the migration of both air and water through the wall, and wherein the casing is placed into the ground with the closed end below the naturally occurring minimum level of the water table and with the sealable open end above the naturally occurring maximum level of the water table and whereby the passages are positioned such that the passages closest to the sealable open end are slightly above the naturally occurring maximum level of the water table and the passages closest to the closed end are below the naturally occurring minimum level of the water table, and wherein the exterior surface of the wall below the ground surface is sealed from exposure to above-ground atmospheric pressure;

at least one pressure transducer inside the casing, the pressure transducer having a reference pressure port;

an electrical cable coupled to each pressure transducer and configured to transmit pressure readings from the pressure transducer, the electrical cable extending from the pressure transducer to above the ground surface by way of the sealable open end;

a tube coupled to each reference pressure port, each tube being vented either above the naturally occurring maximum level of the water table inside the casing, to the local above-ground atmospheric pressure, or to a known reference pressure; and a removable sealing member sealingly engaging the sealable open end and which further permits the electrical cable to sealingly pass through the removable sealing member.

19. A method of measuring the natural level of a water table below the ground surface at a specific location and measuring the natural subterranean air pressure in the geologic material near the surface of the water table at a specific location, the water table having a naturally occurring maximum level and a naturally occurring minimum level and wherein both the maximum and minimum levels occur within a specific time period during which the natural level of the water table is measured, the measured level of the water table and the subterranean air pressure being free from the effects of any artificially created pressure conditions or naturally occurring variations in local above-ground atmospheric pressure conditions, the method comprising:

defining an elongated vertical subterranean cavity whereby the lower end of the cavity is below the naturally occurring minimum level of the water table and the upper end of the cavity is above the naturally occurring maximum level of the water table, and wherein the cavity is sealed to prevent the influence of the above-ground atmospheric pressure, and wherein water accumulates in the cavity from the water table and reaches a level within the cavity that substantially equals the natural level of the water table, and wherein air in the cavity above the water level in the cavity reaches a pressure equal to the natural subterranean air pressure in the geologic material near the surface of the water table; and sensing the pressure of the air in the cavity with respect to a known pressure and sensing the level of the water in the cavity with respect to a known position on the ground surface.

* * * * *